US006067758A

United States Patent [19]

Zenkner

[11] Patent Number: 6,067,758

[45] Date of Patent: May 30, 2000

[54] STAIR CONSTRUCTION ELEMENT

[75] Inventor: Klaus Dieter Zenkner, Furth/Odw., Germany

[73] Assignee: Cosima Zenkner, Furth/Odw., Germany

[21] Appl. No.: 08/991,201

[22] Filed: Dec. 16, 1997

[30] Foreign Application Priority Data

Jun. 25, 1997 [DE] Germany ..... 197 27 043

[51] Int. Cl.[7] ..... E04F 11/00

[52] U.S. Cl. ..... 52/182; 52/179

[58] Field of Search ..... 52/182, 188, 189, 52/190, 191, 177, 179; 428/149, 60, 310, 457

[56] References Cited

U.S. PATENT DOCUMENTS

| | | | |
|---|---|---|---|
| 4,285,177 | 8/1981 | Seegers | 52/179 |
| 4,722,164 | 2/1988 | Scholler | 52/187 |
| 4,869,035 | 9/1989 | Scholler | 52/187 |

FOREIGN PATENT DOCUMENTS

| | | |
|---|---|---|
| 0061707 | 10/1982 | European Pat. Off. . |
| 0839972 | 5/1998 | European Pat. Off. . |
| 2136618 | 2/1972 | Germany . |
| 4403200 | 8/1995 | Germany . |

*Primary Examiner*—Creighton Smith
*Attorney, Agent, or Firm*—Ladas & Parry

[57] ABSTRACT

The invention concerns a stair construction element comprising a horizontal tread part and a nosing-like riser part extending vertically therefrom, for renovating a stair, in which a tread part (2) and a nosing-like riser part (3) form an integral element (1) encased or coated with laminate (4).

8 Claims, 1 Drawing Sheet

STAIR CONSTRUCTION ELEMENT

Figure 1:
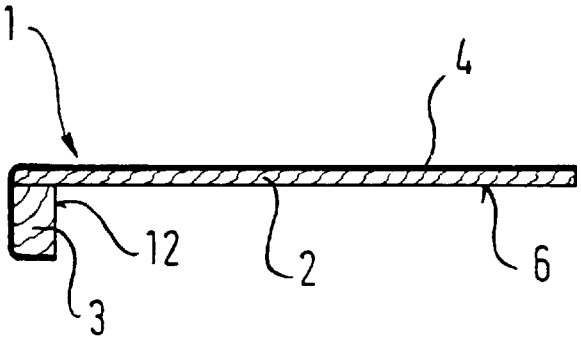

The invention relates to a stair construction element having a horizontal tread part, and a nosing-like riser part extending vertically therefrom, for renovating a stair.

The demand for stairs for refurbishing and renovating stairs, but also for the new construction of stairwells, continues to rise, such stairs usually being made of natural mod or precious wood veneer.

In the recent past, stairs based on laminate-coated composite boards are being used increasingly, with each stair comprising at least three parts, namely, a horizontal tread part, the nosing-like riser part and a metal device connecting the tread part with the nosing-like riser part. This kind of a three-part system requires an angular holding arrangement and thus is relatively expensive to assemble. Also, the surface of the stair is not continuous; as a result, dirt is likely to accumulate constantly in the portion between the horizontal tread and the vertical nosing-like riser.

There has been known for renovating flights of stairs a stair element comprising a tread with a nose having a front end surface and a riser, of the type initially mentioned (DE 44 03 200 A1). In this element, a tread board has a front edge portion and a riser board to cover the riser and to support the tread board. The front edge portion has the form of a section element which is releasable or formed integral with the tread board. Thus, the section element may preferably comprise a polyurethane section cast integral with the tread board. Alternatively, the section element may be of natural wood joined to the tread board by bonding. In any case, it is necessary to provide support for the front edge portion of the tread board, or of the nosing-like riser, respectively, by way of the riser board so as to keep the saidedge portion from being overloaded.

The objective underlying the invention is to provide a stair construction element of the type initially mentioned which accepts extremely high loads for long periods of time and is easy to assemble, visually pleasant and relatively inexpensive.

In accordance with the invention, this task is accomplished by the tread part and the nosing-like riser part forming a single compact laminate-sheathed or coated element, with the compact element preferably consisting of two wood-based materials.

Preferably the tread part and the nosing-like riser part are adhesively bonded and consist of type E1 V100 particle board, or of type E1 V20 medium-density fibre board (MDF board) or of high-density fibre board (HDF board) having the same features. Alternatively, the horizontal tread part and the vertical nosing-like riser part may be formed of bonded coarse-fibre board (OSB board).

The parts constituing the compact stair construction element are bonded by means of conventional postforming apparatus and, particularly, are made under due observation of DIN EN 438 Part 2 of February 1992.

The two bonded parts of the compactelement preferably consist of the following materials:

Fibre board E1 V20 or E1 V100 and/or MDF board E1 corresponding to V20 or V100 and/or HDF board E1 corresponding to V20 or V100 and/or OSB board E1 and/or plastic compact board and/or HPL compact board and/or other supporting materials.

The compact element preferably has its top, front and bottom surfaces at the nosing-like portion coated entirely in a non-detachable manner with a high-pressure laminate (HPL laminate), a continuous laminate (CPL laminate) or a polyester laminate material, any such coating being applied in postforming apparatus.

Instead of an HPL, CPL or polyester laminate, the coating may be formed of epoxy or melamine resin, polyurethane or the like. Preferably, the laminate coat is provided is provided on its upper surface with a top coat highly resistant to abrasion, impact and scratching and having fire-retardant and anti-slip properties. To enhance surface stability, an additional glass fibre layer may be incorporated in the laminate or the top coat. It is possible also to incorporate glass fibre clippings in the resin preparation used for impregnating the laminate papers, which are then pressed together to form the laminate.

On the top surface of the tread part, and on the front portion of the nosing-like riser part, of the compact element the abrasion level preferably is between 12,000 and 24,000 revolutions IP (initial point) as per DIN EN 432/2.

The inventive stair construction elements preferably are provided cut to size or in continuous lengths between 2000 mm and 5300 mm long and between 300 mm and 800 mm wide. Finishes such as oak, beech, maple, cherry, granit and marble may be provided without problems.

The following aspects apply to the provision of the laminate coating on the inventive stair construction element:

An HPL laminate is applied with a pressure of at least 70 bar and at a temperature of approx. 150° C., while a CPL laminate is applied with a pressure of not more than 30 bar and at a temperature of approx. 150° C. HPL laminates are made in the form of panels, CPL laminates in the form of continuous products. HPL laminates have a thickness of 0.4 mm to more than 50 mm. CPL laminates can be made 0.2 mm to max. 1.2 mm thick The difference between the aforesaid V20 and V100 fibre board types (DIN standard designation for the water absorption of fibre board materials) resides in the water absorption during the 24 hrs. water test. A V100 fibre board may exhibit a thickness increase of max. 12% after 25 hrs. dwell in water. E1 stands for an emission class designating the amount of free formaldehyde from fibre board; F0 designates formaldehyde-free fibre board. E1 is the limiting grade just permissible in the western world.

Owing to its design as a one-piece compact element, the stair construction element of the present invention can be assembled rapidly and simply to old wood and stone stairs for the renovation thereof. In addition, the laminate coating provides for durability under extreme loads and, at the same time, for a visually pleasant appearance. The coated surfaces are resistant to moisture, conventional household chemicals, impact and scratching and are light-fast and easy to take care of.

An embodiment of the inventive stair construction element is explained below under reference to the drawings.

Figure 2:
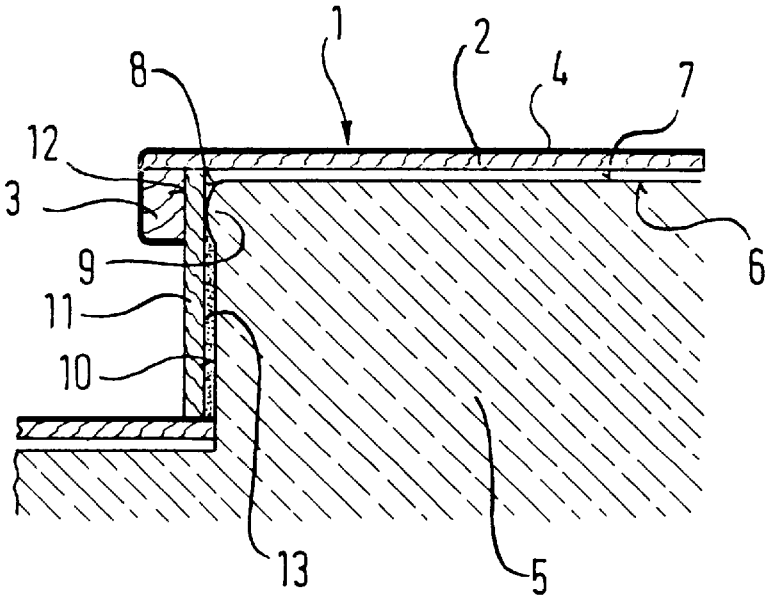

FIG. 1 is a schematic side view of the stair construction element of the invention and FIG. 2 is a schematic side view of the stair construction element of the invention in relation to an old stair.

As will be seen in the embodiment in FIG. 1, the horizontal tread part 2 of compact element 1 and the riser part 3 extending vertically downwardly therefrom are glued together to form a unit encased or coated by a specialised laminate 4. Laminate coating 4 can have a thickness between 0.4 mm and 0.8 mm and can have the quality of cnventional laminate flooring.

As shown in FIG. 2, an old stair 5 is renovated by placing compact element 1 with the bottom surface 6 of tread part 2 down on tread surface 7 of the stair 5 to be renovated, and by fastening it in place, in such a manner that nosing-like riser part 3 of compact element 1 comes to lie in front of end surface 8 of edge 9 of old stair 5, with the distance between riser part 3 and end surface 8 being such that a riser board 11 covering riser 10 abuts both rear surface 12 of the nosing-like riser part 3 of compact element 1 and end surface 8 of the front edge 9 of old stair 5, with an adhesive compound 13 being used to attach riser board ii to compact element 1 and to front edge 9 and riser 10 of old stair 5.

What is claimed is:

1. A construction element for use in a staircase renovation comprising a horizontal part adapted to engage a stair tread and a nosing-like part extending vertically downwardly therefrom protecting the upper part the staircase riser, wherein the horizontal part and nosing-like riser part form an integral compact element which is coated with a laminate surface, formed from a high-pressure laminate applied in a non-detachable manner.

2. A construction element for use in a staircase renovation comprising a horizontal part adapted to engage a stair tread and a nosing-like part extending vertically downwardly therefrom protecting the upper part of the staircase riser, wherein the horizontal part and nosing-like riser part form an integral compact element which is coated with a laminate surface, formed from a continuous laminate applied in a non-detachable manner.

3. A construction element for use in a staircase renovation comprising a horizontal part adapted to engage a stair tread and a nosing-like part extending vertically downwardly therefrom protecting the upper part of the staircase riser, wherein the horizontal part and nosing-like riser part form an integral compact element which is coated with a laminate surface, formed from a polyester laminate applied in an non-detachable manner.

4. A construction element for use in a staircase renovation comprising a horizontal part adapted to engage a stair tread and a nosing-like part extending vertically downwardly therefrom protecting the upper part of the staircase riser, wherein the horizontal part and nosing-like riser part form an integral compact element which is coated with a laminate surface, formed from an epoxy resin applied in a non-detachable manner.

5. A construction element for use in a staircase renovation comprising a horizontal part adapted to engage a stair tread and a nosing-like part extending vertically downwardly therefrom protecting the upper part of the stair case riser, wherein the horizontal part and nosing-like riser part form an integral compact element which is coated with a laminate surface formed from a melamine resin.

6. A construction element as defined in any one of claims 1 to 5, wherein said laminate coating has provided on the top surface thereof a top coat which is highly resistant to abrasion, impact and scratching and having fire-retardant and anti-slip properties.

7. A construction element as defined in claim 1, wherein said laminate coating has a glass fiber layer incorporated therein.

8. A construction element as defined in claim 7, wherein said glass fiber layer includes glass fiber clippings.

* * * * *